United States Patent [19]

Kapuscinski et al.

[11] 4,298,630

[45] Nov. 3, 1981

[54] METHOD OF MANUFACTURING ELECTRICALLY INSULATED CONDUCTORS WITH ULTRA-VIOLET CURED COATINGS

[75] Inventors: Marek Kapuscinski, Montreal; Michel Gervais, Verdun, both of Canada

[73] Assignee: Northern Telecom Ltd., Montreal, Canada

[21] Appl. No.: 76,320

[22] Filed: Sep. 17, 1979

Related U.S. Application Data

[63] Continuation-in-part of Ser. No. 889,231, Mar. 23, 1978, abandoned.

[51] Int. Cl.[3] ..... B05D 3/06

[52] U.S. Cl. ..... 427/44; 156/51; 174/121 SR; 427/54.1; 427/118; 430/284; 430/311

[58] Field of Search ..... 156/272, 51, 307.7, 156/331; 174/110 P, 110 SR, 120 SR, 120 C, 122 R, 121 SR, 121 R, 121 A; 430/284, 311; 204/159.19; 427/44, 54.1, 117, 118

[56] References Cited

U.S. PATENT DOCUMENTS

| | | | |
|---|---|---|---|
| 475,920 | 5/1892 | Bassett | 174/122 C |
| 2,504,845 | 4/1950 | Keyes | 174/121 SR |
| 3,077,462 | 2/1963 | Fitzhugh et al. | 174/110 SR |
| 3,406,248 | 9/1971 | Bunish et al. | 174/120 SR |
| 3,539,424 | 11/1970 | Tashlick | 156/272 |
| 3,891,523 | 6/1975 | Hisamatsu et al. | 204/159.19 |
| 3,911,202 | 10/1975 | Stine et al. | 174/110 SR |
| 3,950,452 | 4/1976 | Schmidt et al. | 174/110 SR |
| 4,022,933 | 5/1977 | Lee | 427/117 |
| 4,062,998 | 12/1977 | Hagiwara et al. | 174/120 C |
| 4,132,812 | 1/1979 | Mathias | 427/117 |
| 4,172,157 | 10/1979 | Nowak et al. | 427/44 |

FOREIGN PATENT DOCUMENTS

| | | | |
|---|---|---|---|
| 51-06085 | 9/1976 | Japan | 427/118 |

*Primary Examiner*—Jerome W. Massie
*Attorney, Agent, or Firm*—R. J. Austin

[57] ABSTRACT

An electrical conductor has a coating or layer of U-V cured material on the metallic conducting member. The ultra-violet cured coating is partially cured before application of pulp insulation. Further curing then produces a chemical bond between the ultra-violet cured coat and the pulp insulation to assist in holding the pulp on the conducting member. The conductor is economic to produce while providing an efficient moisture barrier between the pulp insulation and conducting member.

4 Claims, 3 Drawing Figures

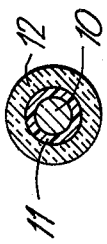
Fig. 1
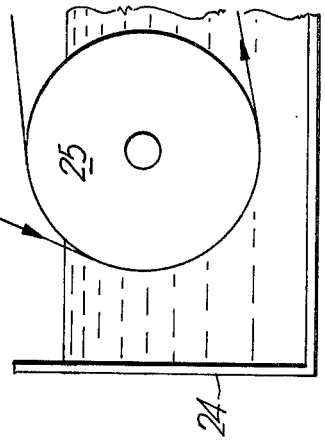
Fig. 2
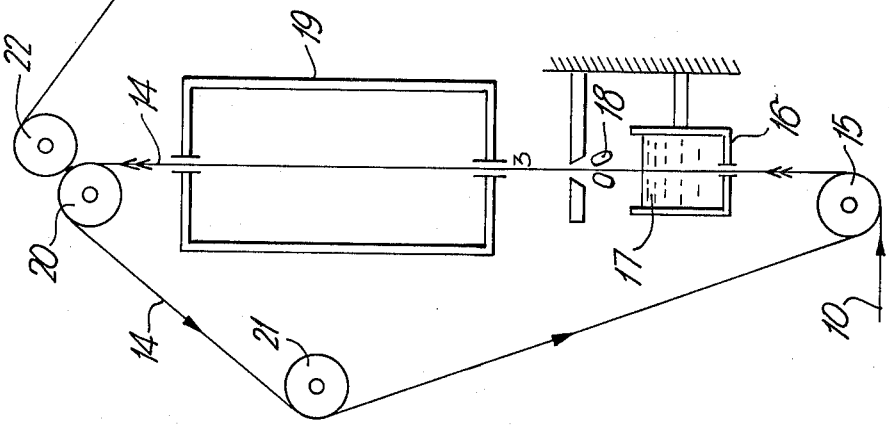
Fig. 3
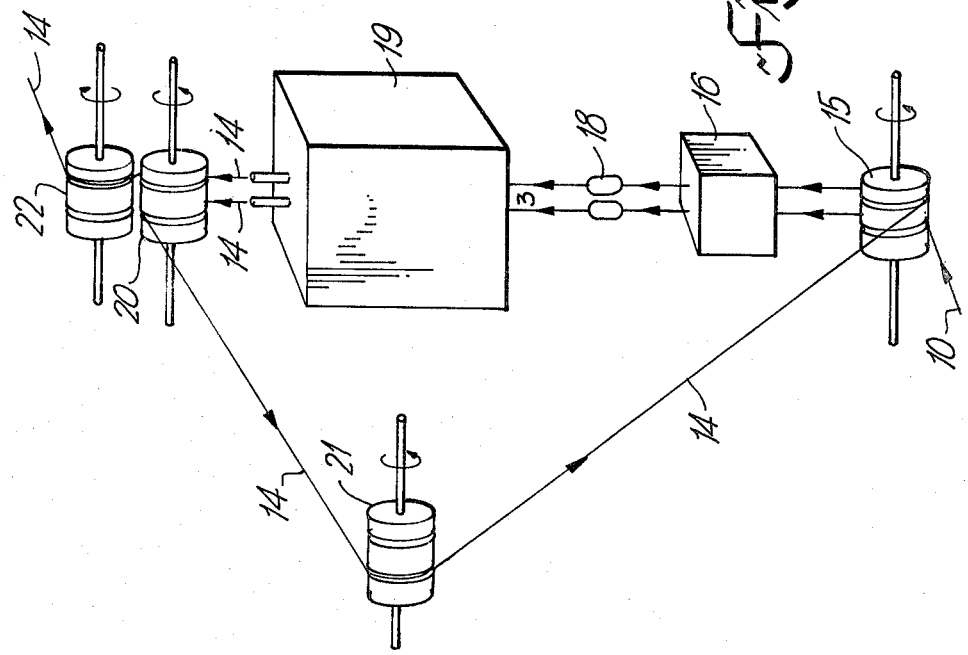

METHOD OF MANUFACTURING ELECTRICALLY INSULATED CONDUCTORS WITH ULTRA-VIOLET CURED COATINGS

This application is a Continuation-In-Part of application Ser. No. 889,231, filed Mar. 23, 1978, now abandoned.

This invention relates to telecommunications cables and methods for producing them.

Pulp insulation for electrical conductors of telecommunication cables is favoured because of its excellent insulation properties and because it is inexpensive. However, pulp insulation is subject to problems caused by residual moisture within the pulp and which migrates as a result of internal temperature gradients produced at least partly by location of conductors underground in close proximity in different areas with hot and cold environments, e.g. steam pipes and the ground surface. There is a flow of pressurized gas in cables and this combined with the temperature gradients causes condensation problems.

To protect the conductors from the conducting effects and resultant changes in insulating efficiency, the conductors are enamelled. However, it is known in practice that the enamelling procedure increases the cost of a cable by up to or around 65% and this offsets the inexpensive pulp insulation.

The applicants provide a telecommunications cable in which the conductor is protected from problems associated with condensation or dampness by providing a barrier layer which is different from and less expensive than an enamelled layer.

Accordingly, the present invention is a telecommunications cable having an electrically insulated conductor comprising a metallic conducting member, a layer of ultra-violet cured material surrounding the conducting layer, and a layer of pulp insulation over and chemically bonded to the layer of ultra-violet cured material at an interfacial region between the layers.

The invention also provides a method for producing an electrically insulated conductor for a telecommunications cable in which a conducting member is covered with a layer of an uncured photopolymer, the layer then being partially cured with ultra-violet light, and after the addition of a layer of pulp insulation directly over the partially cured photopolymer layer, the photopolymer layer is further cured while causing a chemical bond to take place between the two layers and at an interfacial region.

The invention will be readily understood by the following description with typical examples, in conjunction with the accompanying drawings, in which:

FIG. 1 is a diagrammatic cross-section through a conductor embodying the invention;

FIG. 2 is a diagrammatic illustration of one form of apparatus; and

FIG. 3 is a diagrammatic perspective view of an apparatus as in FIG. 2.

A typical conductor is illustrated in FIG. 1, and comprises a copper or other metallic conducting member 10, a layer of ultra-violet cured material 11 and a layer of pulp insulation 12 chemically bonded to the layer of ultra-violet cured material at an interfacial region between the layers. The example is a typical pulp insulated conductor used in telecommunications cables.

The material of layer 11 is a photopolymerising material, and a number of such materials suitable for the present invention will be described later.

FIGS. 1 and 3 illustrate a particular process and form of apparatus for applying a photopolymerising or U-V curing, coating to a wire, the coating applied in two layers. The apparatus is conveniently positioned before a pulp bath 24.

The conducting member 10 is fed from a coil or reel, not shown, and passes around a grooved roller 15, up through a bath or reservoir 16 containing a photopolymer 17. From the bath 16 the coated wire 14 passes through self-cenering dies 18 which remove excess polymer to give an even first coating and then the coated wire passes through a high-intensity U-V light chamber 19 which partially cures the coating. From the chamber 19 the wire 14 passes over grooved rollers 20 and 21 back to the first roller 15, passing up through the bath 16, dies 18 and chamber 19 for a second coating. The first coating of polymer is further cured and the second coating partially cured as the coated wire passes through the chamber 19 to form the layer 11 in FIG. 1.

After passing the second time through the bath 16 and chamber 19 the coated conducting member 14 passes over rollers 22 and 23 and into the pulp bath 24, the conducting member passing over drum 25 in the bath. The application of the pulp insulation is conventional. The pulp insulated conductor is then passed through a pulp oven to dry the the pulp. The oven also effects further curing of the layer 11 which causes a chemical bond to take place at an interfacial region between the layers 11 and 12. This bond results in the pulp insulation being firmly secured to the underlying cured material 11.

The cured photopolymer layer 11 is a successful barrier to damp and condensation in the pulp insulation.

Thus, the layer 11 is a successful replacement for conventional enamelling of conducting member while being markedly cheaper to use to result in a more economic electrically insulated conductor. In fact with current costing, the use of the layer 11 results in a cost increase of about 6% for a given insulated conductor as compared with about 65% when using conventional enamelling. Futher to this, there is the additional advantage offered by the applicants' invention and that is the firm securing of the pulp insulation to the photopolymer layer by the chemical bond formed during the curing stage effected after the application of the pulp insulation.

A typical composition for the photopolymer is a urethane oligomer, acrylic monomer dilutents and a chemical photosensitizer. A variety of photopolymers can be used.

A typical urethane oligomer would be either an adipate backbone, reacted with an isocyanate and capped with an acrylate, or one based on an ethylene propylene glycol. These materials are marketed under the trademarks Uvithane 788 and 783 respectively by Thiokol.

Prior to application and curing the urethane oligomer is diluted with one or more monomers, for example one or more of the following:

Ethoxyethoxyethyl Acrylate
N-Vinylpyrrolidone
Phenoxyethyl Acrylate
Cellosolve Acrylate
Tetraethylene Glycol Diacrylate
Hexanediol Diacrylate
Tetrahydrofurfuryl Acrylate 2-Ethyl Hexyl Acrylate
Vinyl Acetate At this time is also added the photosensitizer, plus any other additives.

The proportions of urethane oligomer to diluent monomers varies in accordance with the dictates of the particular applicator chosen. For example, a die applicator requires the compound to have a higher viscosity than is the case for a reverse roll applicator where natural flow of the compound around the conducting member is required, after passing through the applicator, to produce a substantially uniform thickness of compound upon the member. In the case of the use of a die applicator, a preferable viscosity has been found to be within the range of 6,000 to 15,000 centipoise. Where a die applicator is used, a more uniform thickness is provided by the applicator because of the self-centering action of the conducting member through the dies and the higher viscosity assists in retaining the uniform thickness. It is also helpful in this regard to have a high surface tension compound. This may be achieved by the use of polycarbinols of which Dow Corning DC 193 is a typical example. It is important in either method of application to have a compound with high wetting properties in conjunction with the surface of the conducting member.

Ingredients of the compound it is believed should not react with water. Monofunctional materials should have activities which are comparable with each other and acrylates should not cure together to form their own crosslinked arrangement but should cross-link into the urethane oligomer chain.

Thus for die application, the total formulation would comprise about 60% or more by weight of oligomer and the remainder dilutent plus sensitizer—plus any other additives. The sensitizer may comprise about 4% by weight of the total but should generally be within the range of 2% to 6%.

Two typical formulations for die application are:

| | Parts by Weight | |
|---|---|---|
| | Formulation A | Formulation B |
| Urethane oligomer | 66.5 | 67.0 |
| Vinyl acetate | 5.5 | — |
| Phenoxyethyl acrylate | 12.9 | 14.5 |
| 2-ethyl hexyl acrylate | 6.5 | 7.0 |
| Tetra-ethylene glycol diacrylate | 4.6 | 7.5 |
| Pentaerythritol tetracrylate | 4.0 | 4.0 |
| Photo initiator | 3.85 | 4.0 |
| Polycarbinol | 3.85 | 4.0 |

The above formulations when used as the ultra-violet cured photopolymer layer as a moisture barrier from the pulp insulation to the conducting member result in electrically insulated conductors in which the dielectric strength and insulation resistance properties are at acceptable levels for acceptable lifetimes. For instance on one construction, it has been ascertained that dielectric strength is maintained for a lifetime of 40 years at 102° C. and insulation resistance is maintained for a period of 15 years at 20° C. submerged in water. Flexibility of conductors and the adhesion of the pulp to the ultra-violet cured layer are also acceptable for normal commercial use.

In another formulation for application by a conventional reverse roll applicator, the following ingredients were used:

| | Parts by Weight |
|---|---|
| Urethane oligomer | 40 |
| Phenoxyethyl acrylate | 22 |
| 2-ethyl hexyl acrylate | 8 |
| Tetrahydrofurfuryl acrylate | 10 |
| Ethoxyethoxyethyl acrylate | 10 |
| Tetra-ethylene glycol diacrylate | 7 |
| Pentaerythritol tetracrylate | 3 |
| Polycarbinol | 3.5 |
| Photo initiator | 4.0 |

In the change to the above formulation, the photo initiator should not exceed 8 parts by weight.

The U-V light source is chosen to have spectrums compatible with the particular photosensitizers used in the photopolymer formulations.

The speed of the coated conductor is associated with the length of the path through the chamber 19 and the intensity of the U-V light, and also the speed of the pulp insulation line when pulp insulation is being applied. Typical speed of a pulp line is about 200 ft/min. with a length of approximately 8–10 feet for the path through chamber 19.

The two-pass method gives a more uniform cure through the total coating thickness, with superior coating/conductor concentricity and very low probability of "wetting" flaws, which would result in pin holes. However, a single pass could be used, depending upon requirements.

The invention has several further advantages. There is a low floor space requirement and low power requirement for the use of the process. It is also a completely solventless system. There is little or no extra labour requirement as the apparatus is a tandem addition to existing apparatus. Conductors having U-V cured layers over which is a layer of pulp insulation material may be made up into cables in the conventional manner.

What is claimed is:

1. A method for producing an electrically insulated conductor for a telecommunications cable consisting of:
- covering a conducting member with a layer of an uncured photopolymer by passing it through a bath of the photopolymer;
- partially curing the layer with ultra-violet light;
- applying a layer of pulp insulation directly over the partially cured photopolymer layer, and further curing the photopolymer layer to cause a chemical bond to take place between the two layers at an interfacial region.

2. A method according to claim 1 comprising applying the photopolymer in a form comprising a urethane oligomer, at least one acrylic monomer diluent and a chemical photosensitizer.

3. A method according to claim 2 wherein the urethane oligomer comprises one of (a) an adipate backbone reacted with an acrylate, and (b) one based on an ethylene propylene glycol.

4. A method for producing an electrically insulated conductor for a telecommunications cable comprising:
- covering a conducting member with a layer of an uncured photopolymer by passing it through a bath of the photopolymer to provide a first coating, partially curing the first coating by ultra-violet light and then covering the first coating with a second coating;
- partially curing the second coating of the layer of photopolymer with ultra-violet light;
- applying a layer of pulp insulation directly over the partially cured photopolymer layer and further curing the photopolymer layer to cause a chemical bond to take place between the two layers at an interfacial region.

* * * * *